US010112289B2

(12) United States Patent
Miller et al.

(10) Patent No.: US 10,112,289 B2
(45) Date of Patent: Oct. 30, 2018

(54) TOOL FOR PULLING IMPELLER WEAR RING

(71) Applicants: Alexander K. Miller, Dallas, TX (US); Shane McWhorter, Murchison, TX (US); Louis C. Bock, West Lake Hills, TX (US)

(72) Inventors: Alexander K. Miller, Dallas, TX (US); Shane McWhorter, Murchison, TX (US); Louis C. Bock, West Lake Hills, TX (US)

( * ) Notice: Subject to any disclaimer, the term of this patent is extended or adjusted under 35 U.S.C. 154(b) by 0 days.

(21) Appl. No.: 15/344,289

(22) Filed: Nov. 4, 2016

(65) Prior Publication Data

US 2017/0072547 A1 Mar. 16, 2017

Related U.S. Application Data

(62) Division of application No. 14/242,483, filed on Apr. 1, 2014, now Pat. No. 9,486,902.

(51) Int. Cl.
*B25B 27/02* (2006.01)
*B25B 27/06* (2006.01)

(52) U.S. Cl.
CPC ..... *B25B 27/023* (2013.01); *B25B 27/062* (2013.01)

(58) Field of Classification Search
CPC ..... B25B 27/06; B25B 27/02; B25B 27/023; B25B 25/00; B25B 27/00; Y10T 29/49741; Y10T 29/4995; Y10T 29/49963; Y10T 29/53883
USPC .... 29/255, 244, 253, 274, 525.11, 258, 259, 29/260, 261, 898.01, 898.08; 269/24, 27, 269/32
See application file for complete search history.

(56) References Cited

U.S. PATENT DOCUMENTS

| | | | | | |
|---|---|---|---|---|---|
| 1,164,704 | A * | 12/1915 | Courembis | B25B 23/106 | 29/262 |
| 1,534,350 | A * | 4/1925 | Bassett | B25B 27/023 | 29/261 |
| 2,953,846 | A * | 9/1960 | Wagner | B25B 27/023 | 254/98 |
| 2,971,254 | A * | 2/1961 | Fairfield | B25B 27/023 | 29/261 |
| 5,613,288 | A * | 3/1997 | Lundsten | B25B 27/06 | 29/255 |
| 5,735,033 | A * | 4/1998 | Marugg | B25B 27/023 | 29/254 |
| 7,216,409 | B1 * | 5/2007 | Chiu | B25B 27/023 | 29/255 |
| 2005/0229373 | A1 * | 10/2005 | Hu | B25B 27/023 | 29/261 |
| 2013/0152353 | A1 * | 6/2013 | Hu | B25B 27/023 | 29/261 |

* cited by examiner

*Primary Examiner* — David Bryant
*Assistant Examiner* — Lawrence Averick
(74) *Attorney, Agent, or Firm* — Frost Brown Todd LLC

(57) ABSTRACT

Described herein is a tool for removing a wear ring, the tool comprising: a base; a leg base; a spreader disc comprising: a top, bottom, and sloped edge; a plurality of legs comprising: a first end coupled to the leg base, and a saw tooth shaped end; a plurality of spreader bolts, passing though the base and threaded into the spreader disc; and a puller bolt, passing through the base and spreader disc; and threaded into the leg base.

5 Claims, 8 Drawing Sheets

TOOL FOR PULLING IMPELLER WEAR RING

CROSS REFERENCE TO RELATED INFORMATION

This application is a divisional of U.S. patent application Ser. No. 14/242,483, filed Apr. 1, 2014, titled Tool for Impeller Wear Ring, now U.S. Pat. No. 9,486,902, issued Nov. 8, 2016, the contents of which are hereby incorporated herein in its entirety.

TECHNICAL FIELD

The present disclosure is directed generally to tools for removing wear rings. Specifically, a tool for pulling a jet ski impeller wear ring from the impeller housing.

BACKGROUND OF THE INVENTION

Some vehicles are propelled using water jets. Water is pulled into a channel using an impeller. The impeller spins and pulls water through the channel, the channel may be tapered such that the exit is a smaller diameter than the entry. A housing typically encases the impeller, a motor, and the channel. In some cases, a tapered channel allows for an increase in the speed of the water passing through the channel, thus causing a water jet to propel a vehicle connected to the housing. To improve efficiency, the impeller and the channel should be substantially similar in diameter. The housing may have a replaceable wear ring around the impeller. The wear ring wears as debris, for example sand or rock, is pushed against it by the impeller. As it wears, the wear ring may need replacement in order for the efficiency of the motor to remain high. Presently wear rings are removed by chipping them out with a screw driver or other chisel like tool, breaking the wear ring into pieces and consuming a significant amount of man hours to remove.

BRIEF SUMMARY OF THE INVENTION

In an embodiment, a tool for removing a wear ring is described. The tool comprising: a base; a leg base; a spreader disc comprising: a top, bottom, and sloped edge; a plurality of legs comprising: a first end coupled to the leg base, and a saw tooth shaped end; a plurality of spreader bolts, passing though the base and threaded into the spreader disc; and a puller bolt, passing through the base and spreader disc; and threaded into the leg base.

In another embodiment a tool for removing a wear ring is described. The tool comprising: a base; a spreader disc comprising: a top, bottom, and sloped edge; a plurality of legs comprising: a first end coupled to the base, and a saw tooth shaped end; a plurality of spreader bolts, passing though the base and threaded into the spreader disc; and a puller bolt, passing through the spreader disc; and threaded into the base.

In another embodiment, a method for wear ring removal is described. The method comprising the steps of: inserting legs of a wear ring removal tool into a channel formed by the wear ring, the legs coupled to a base; tightening a plurality of spreader bolts causing a spreader to engage the legs with the wear ring, the spreader bolts passing through holes in the base into the spreader; and tightening a puller bolt, the puller bolt passing through the spreader and engaging an impeller.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
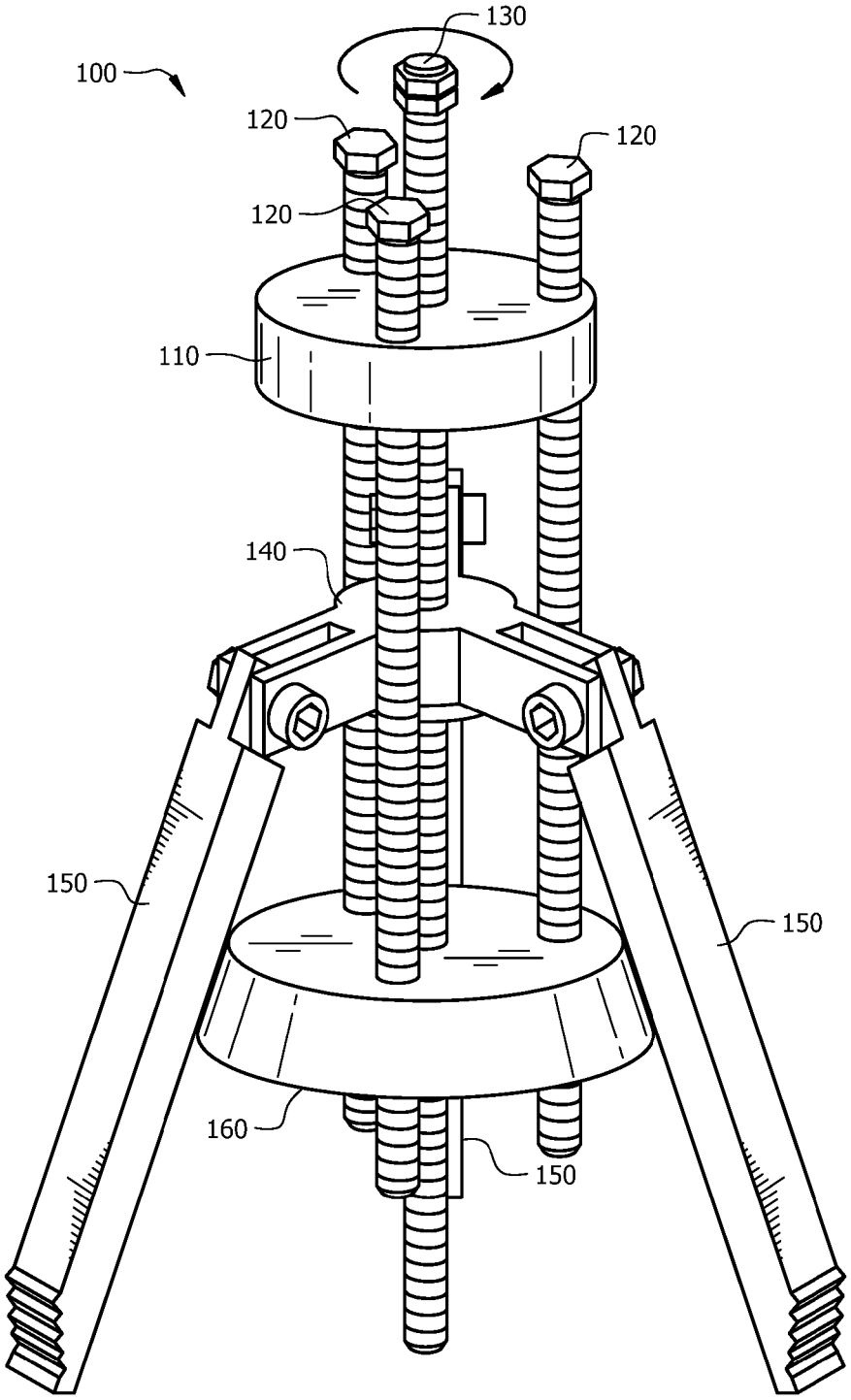
FIG. 1 is a diagram of a preferred embodiment of a tool for pulling an impeller wear ring.
Figure 2:
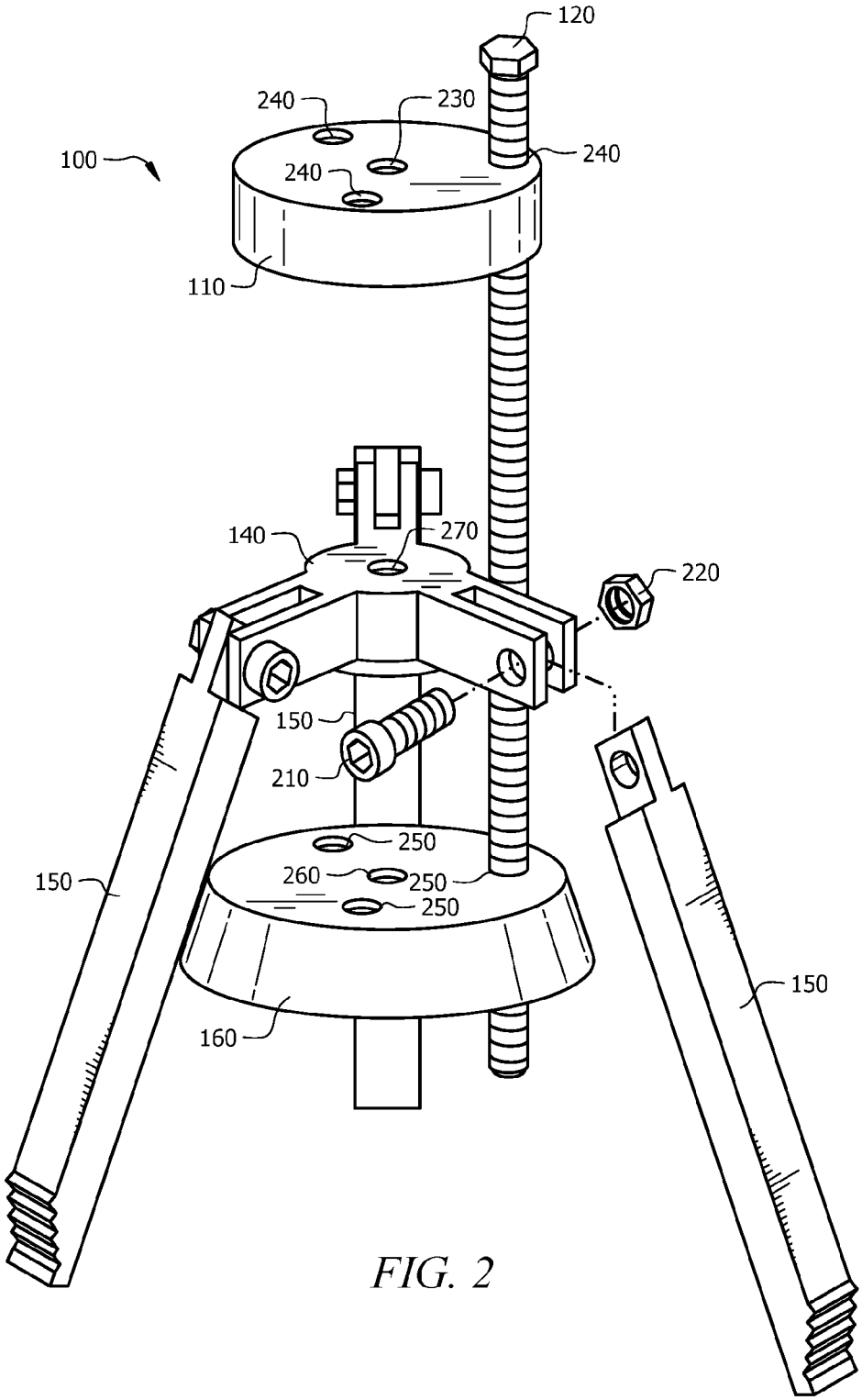
FIG. 2 is an exploded view of a preferred embodiment of a tool for pulling an impeller wear ring.
Figure 3:
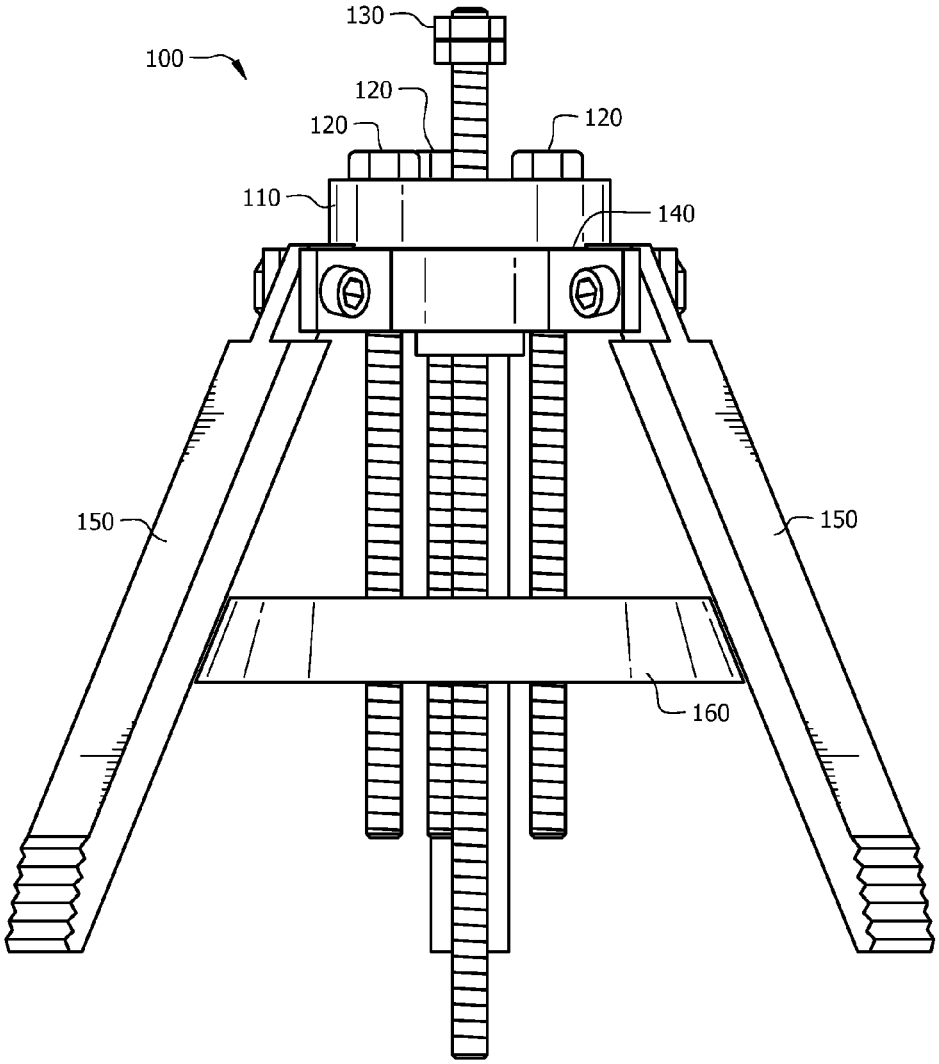
FIG. 3 is a side view of a preferred embodiment of a tool for pulling an impeller wear ring.
Figure 4:
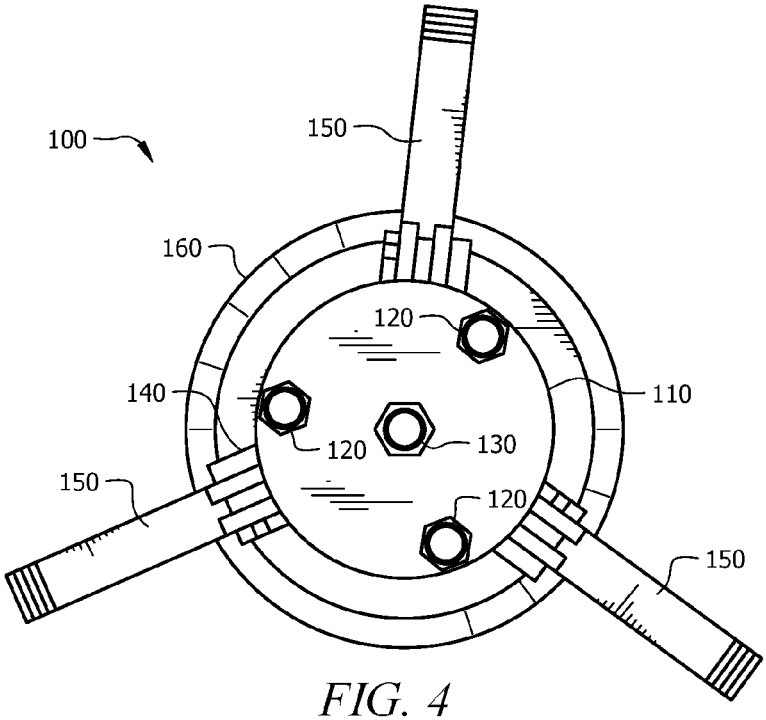
FIG. 4 is a top view of a preferred embodiment of a tool for pulling an impeller wear ring.
Figure 5:
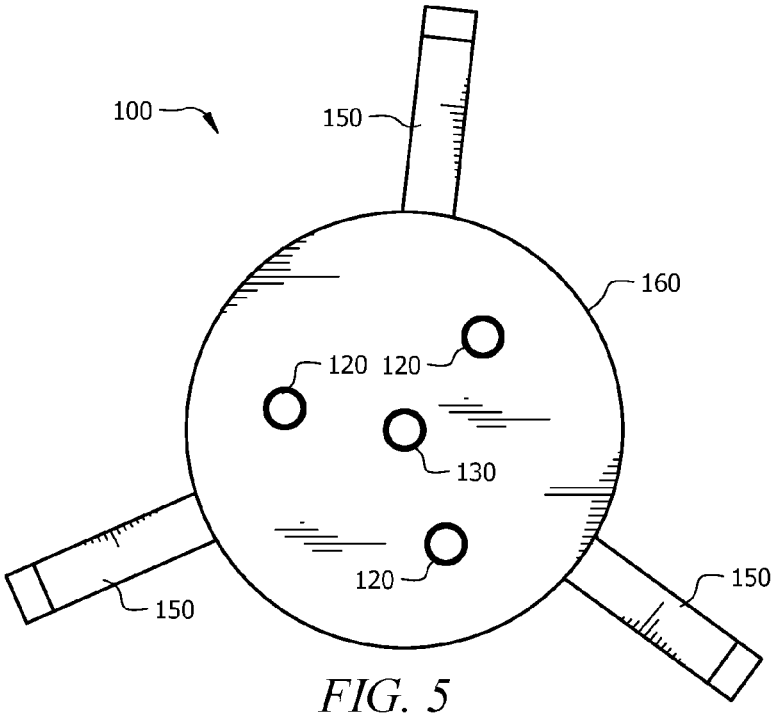
FIG. 5 is a side view of a preferred embodiment of a tool for pulling an impeller wear ring.

FIG. 1 is a diagram of a preferred embodiment of a tool for pulling an impeller wear ring 100. The tool for pulling an impeller wear ring 100 may comprise an upper base 110, several spreader bolts 120, a puller bolt 130, a leg base 140, several legs 150, and a spreader 160. Embodiments of spreader 160 may be shaped like a disc with an angled side, such that the top of spreader 160 may have a smaller diameter than the bottom of spreader 160.

FIG. 2-FIG. 5 show various views of an embodiment of a tool for pulling an impeller wear ring 100. The tool for pulling an impeller wear ring will be described in further detail in light of FIG. 1 and FIG. 2. Legs 150 may have a hole through one end for securing legs 150 to leg base 140. The opposite end of legs 150 may be of a saw tooth shape to allow for increased grip against a wear ring. Legs 150 may be coupled to leg base 140 using a bolt 210 secured by a nut 220. While a bolt 210 and nut 220 are depicted, any mechanism for securing legs 150 to leg base 140 may be used, so long as the legs can pivot at the leg base connection.

Hole 230 in upper base 110 may be of a slightly larger diameter than puller bolt 130. Hole 230 may also be unthreaded to allow puller bolt 130 to move freely through hole 230. Holes 240 in upper base 110 may be of a slightly larger diameter than spreader bolts 120. Holes 240 may also be unthreaded to allow spreader bolts 120 to move freely through holes 240. Hole 270 in leg base 140 is preferably threaded to fit puller bolt 130. Holes 250 in spreader may be threaded to fit spreader bolts 120. Hole 260 may be of a slightly larger diameter than puller bolt 130. Hole 260 may also be unthreaded to allow puller bolt 160 to move freely through hole 260.

Figure 6A:
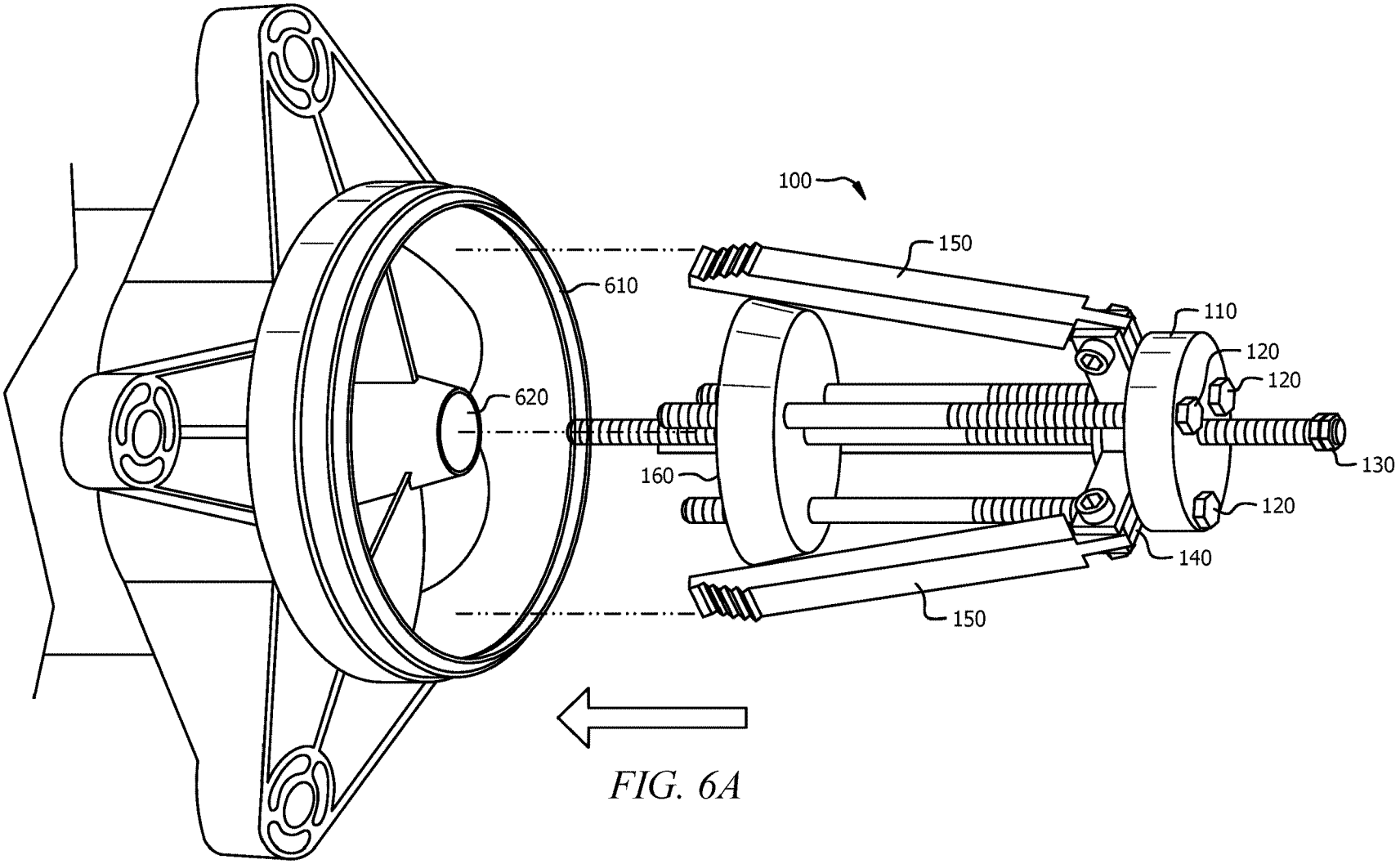
FIG. 6A is a diagram of a preferred embodiment of a tool for pulling an impeller wear ring insertion.
Figure 6B:
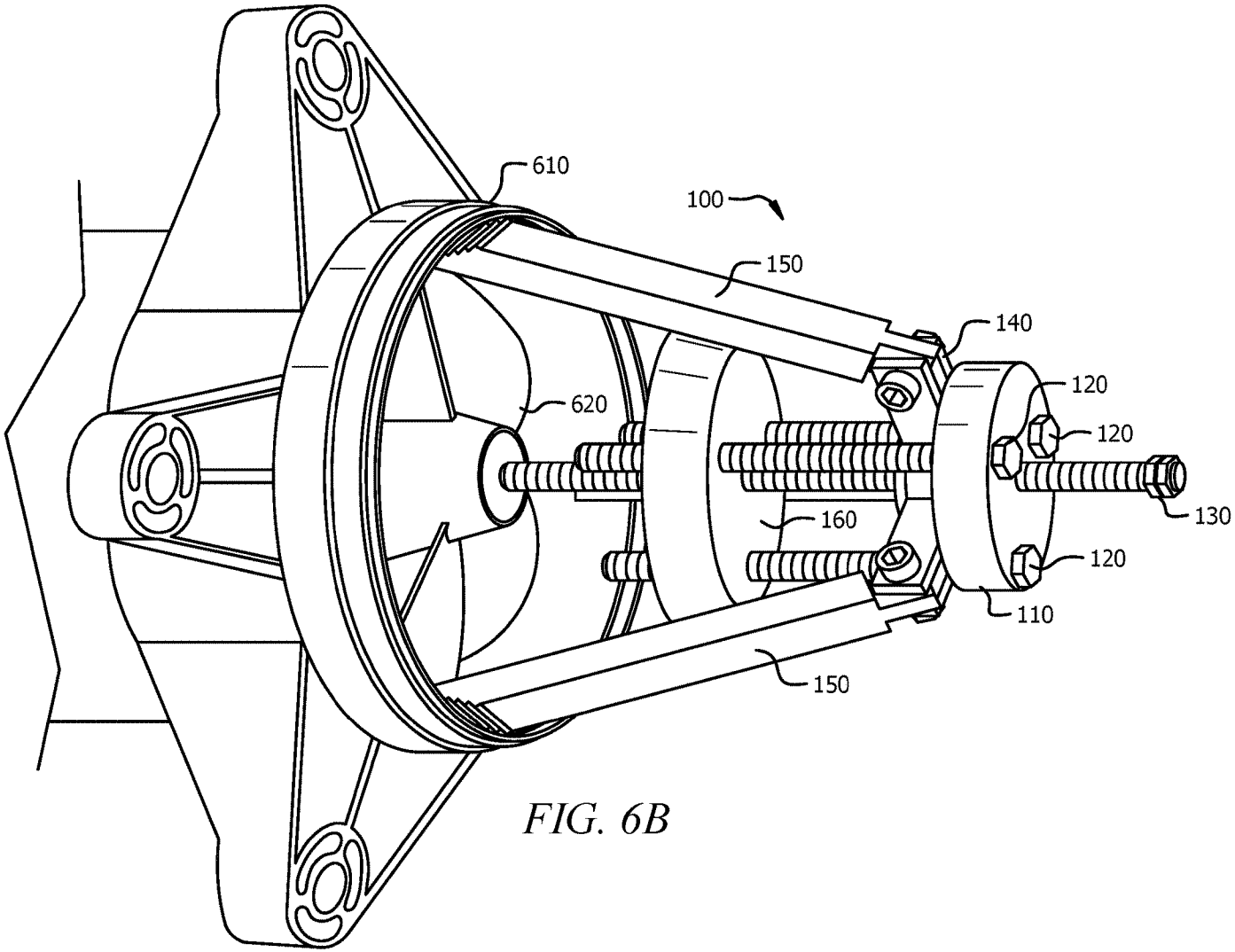
FIG. 6B is a diagram of a preferred embodiment of a tool for pulling an impeller wear ring after insertion.
Figure 6C:
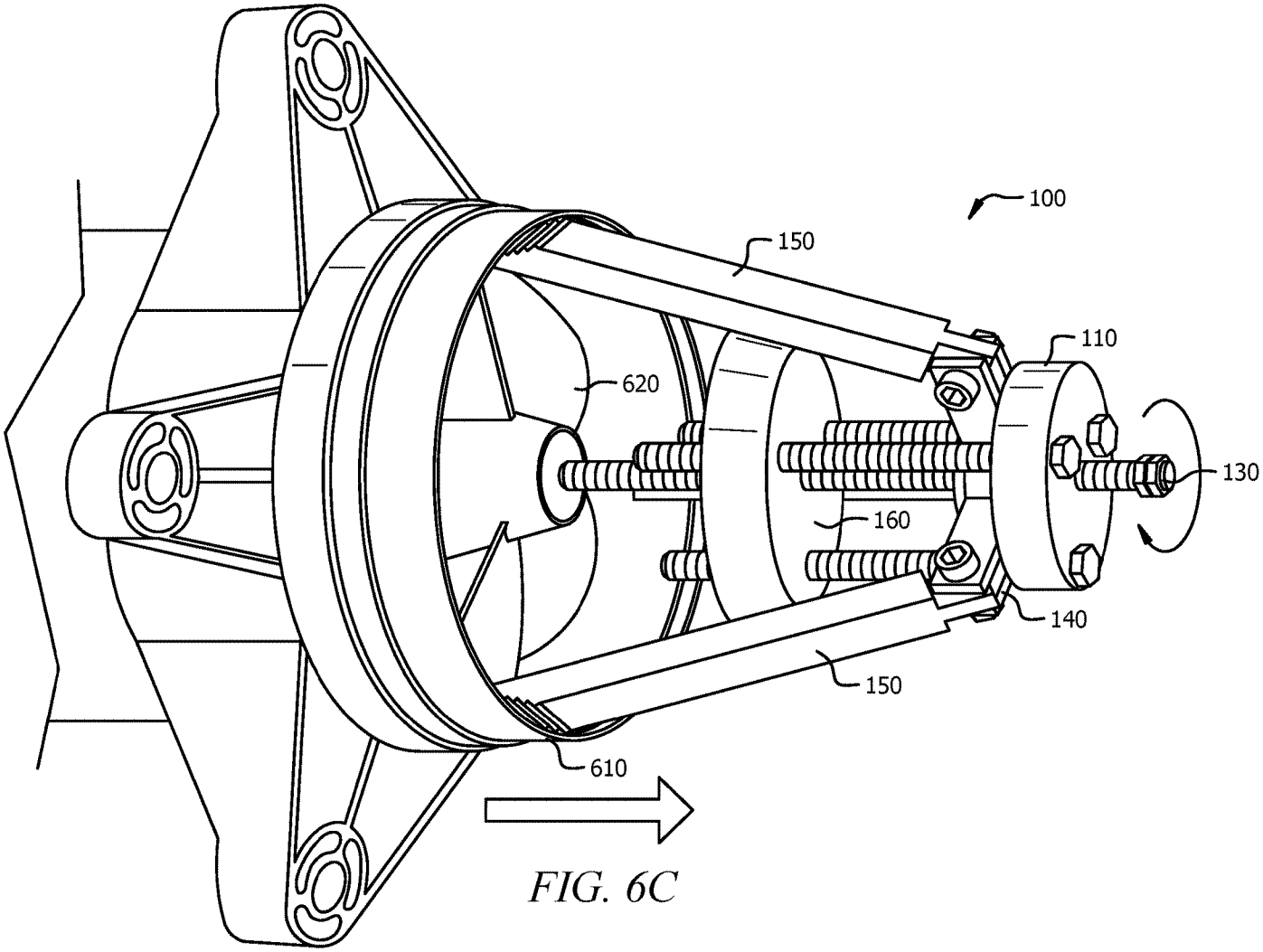
FIG. 6C is a diagram of a preferred embodiment of a tool for pulling an impeller wear ring removal.

FIG. 6A-FIG. 6C are diagrams showing the operation of an embodiment of a tool for pulling an impeller wear ring 100. The tool for pulling an impeller wear ring 100 may be inserted into a cavity surrounded by wear ring 610. Spreader 160 may be positioned near the saw tooth end of legs 150, reducing the overall diameter of the tool for pulling an impeller wear ring 100. The position of spreader 160 is determined by tightening or loosening spreader bolts 120. As spreader bolts 120 are tightened, spreader 160 is drawn upwards. Spreader 160 has tapered sides which may cause legs 150 to spread outward toward the wear ring 610 as spreader 160 is drawn upwards towards leg base 140. During insertion of tool for pulling an impeller wear ring 100, spreader 160 will be closer to the saw tooth portion of legs 150 than leg base 140. The tool for pulling an impeller wear ring 100 may be inserted into the cavity surrounded by the wear ring to a depth about equal to the saw tooth portion of the legs 150.

Referring now to FIG. 6B, after the tool for pulling an impeller wear ring 100 has been inserted into the channel to a depth about equal to the saw tooth portion of the legs 150, spreader bolts 120 may be tightened. When spreader bolts 120 are tightened, spreader 160 may be pulled towards leg base 140, causing legs 150 to spread and press against wear ring 610. While tightening of bolts are described herein, other devices may be used that cause the spreader to be pulled toward upper base 110, for example a ratcheting device.

Referring now to FIG. 6C, after the legs 150 are pressed firmly against wear ring 610, puller bolt 130 may be tightened. As puller bolt 130 is tightened, it may press against impeller 620. As puller bolt 130 is further tightened, leg base 140 is drawn up puller bolt 130 by the threads in hole 270 and begins to pull legs 150 out of the cavity surrounded by the wear ring 610. Because legs 150 are engaged with wear ring 610, legs 150 will pull wear ring 610 from the impeller housing. As puller bolt 130 is further tightened, wear ring 610 is removed from the impeller housing. Once wear ring 610 is removed, a new wear ring may be inserted. While tightening of bolts are described herein, other devices may be used that cause the legs to be pulled toward upper base 110, for example a ratcheting device.

Figure 7:
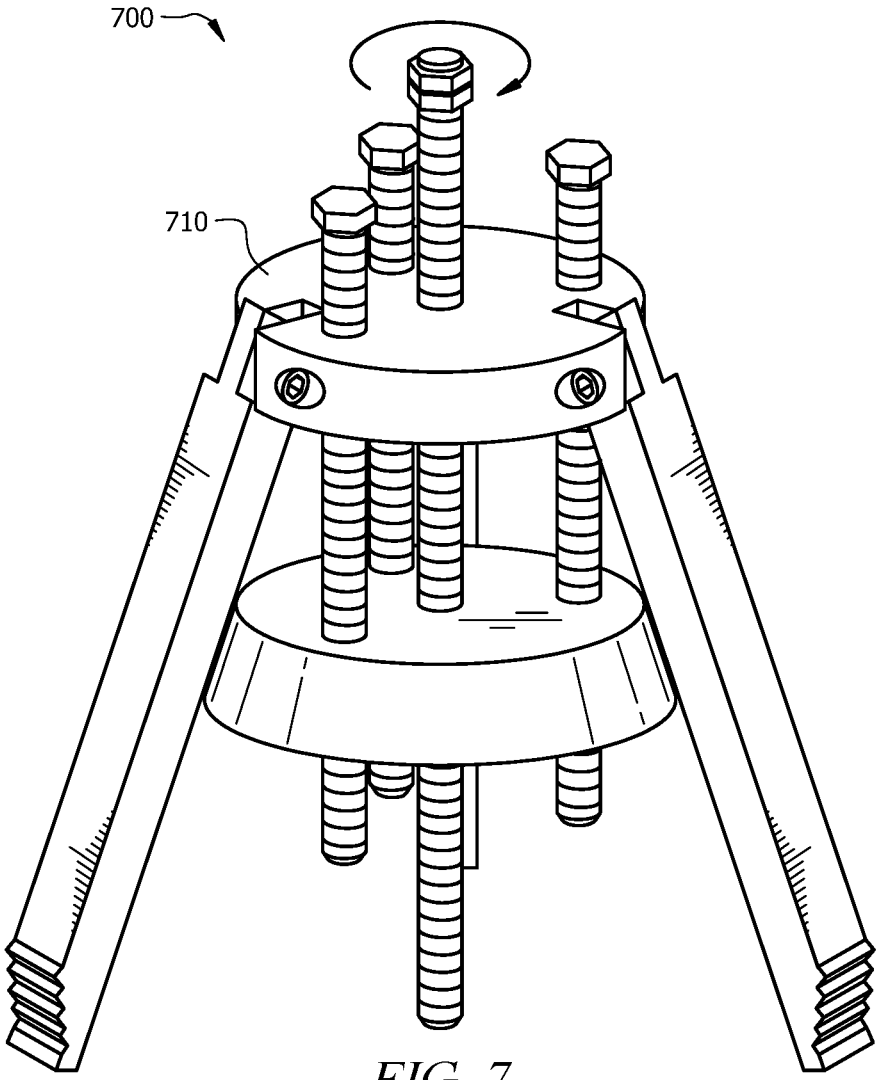
FIG. 7 is a diagram of an alternate embodiment of a tool for pulling an impeller wear ring.

FIG. 7 is a diagram of an alternate embodiment of a tool for pulling an impeller wear ring 700. In this embodiment, upper base 110 of FIG. 1 and leg base 140 of FIG. 1 may be replaced by a single base 710. In this embodiment, the puller bolt hole in single base 710 may be threaded. The remaining functionality of the tool for pulling an impeller wear ring remains substantially similar to that of tool for pulling an impeller wear ring 100 of FIG. 1.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for wear ring removal comprising:

inserting legs of a wear ring removal tool into a channel formed by the wear ring, the legs coupled to a base;

tightening a plurality of spreader bolts causing a spreader to engage the legs with the wear ring, the plurality of spreader bolts passing through holes in the base into threaded holes in the spreader, the spreader configured to move up and down along the plurality of spreader bolts during operation such that as the plurality of spreader bolts are tightened the spreader is drawn toward the base in order to effectuate spreading of the legs; and tightening a puller bolt, the puller bolt passing through the spreader and engaging an impeller.

2. The method of claim 1, wherein the legs comprises three legs.

3. The method of claim 1, wherein the spreader bolts comprises three spreader bolts.

4. The method of claim 1, wherein the spreader comprises: a top, bottom, and sloped edge.

5. The method of claim 4, wherein the top comprises a diameter smaller than a diameter of the bottom.

* * * * *